US010738796B2

(12) United States Patent
Horng et al.

(10) Patent No.: US 10,738,796 B2
(45) Date of Patent: Aug. 11, 2020

(54) FAN FRAME OF AN AXIAL-FLOW FAN

(71) Applicant: Sunonwealth Electric Machine Industry Co., Ltd., Kaohsiung (TW)

(72) Inventors: Alex Horng, Kaohsiung (TW); Sheng-Chieh Liang, Kaohsiung (TW); Chih-Hao Mai, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 180 days.

(21) Appl. No.: 15/794,050

(22) Filed: Oct. 26, 2017

(65) Prior Publication Data

US 2018/0142708 A1 May 24, 2018

(30) Foreign Application Priority Data

Nov. 21, 2016 (TW) ..... 105217769 U

(51) Int. Cl.

| | |
|---|---|
| ***F04D 29/66*** | (2006.01) |
| ***F04D 25/06*** | (2006.01) |
| ***F04D 29/52*** | (2006.01) |
| ***F04D 19/00*** | (2006.01) |

(52) U.S. Cl.

CPC ..... *F04D 29/668* (2013.01); *F04D 19/002* (2013.01); *F04D 25/0613* (2013.01); *F04D 29/522* (2013.01)

(58) Field of Classification Search

CPC .. F04D 29/668; F04D 25/0613; F04D 29/522; F04D 19/002

See application file for complete search history.

(56) References Cited

U.S. PATENT DOCUMENTS

| | | | | |
|---|---|---|---|---|
| 8,137,064 | B2 * | 3/2012 | Takemoto | F04D 29/544 415/211.2 |
| 2005/0042088 | A1 * | 2/2005 | Horski | F04D 29/601 415/213.1 |
| 2007/0128022 | A1 * | 6/2007 | Yeh | F04D 19/002 415/220 |
| 2008/0175705 | A1 * | 7/2008 | Liu | F04D 29/601 415/119 |

FOREIGN PATENT DOCUMENTS

| | | | |
|---|---|---|---|
| CN | 2653189 | Y * | 11/2004 |
| CN | 2653189 | Y | 11/2004 |
| TW | M445644 | U | 1/2013 |

* cited by examiner

*Primary Examiner* — Sizo B Vilakazi

(74) *Attorney, Agent, or Firm* — Alan D. Kamrath; Karin L. Williams; Mayer & Williams PC

(57) ABSTRACT

A fan frame of an axial-flow fan is provided to reduce the vibration generated during the rotation of the impeller that is transmitted to the outside of the axial-flow fan via the fan frame. The fan frame includes a housing, a base and a plurality of connection members. The base includes a shaft-coupling portion. Each of the plurality of connection members includes two ends respectively connected to the housing and the base. Each of the plurality of connection members is defined with an extension line passing through the two ends of the connection member. Each of the plurality of connection members includes a first bending portion and a second bending portion. The first bending portion extends around a first notch, and the second bending portion extends around a second notch. The extension line extends through the first and second notches.

20 Claims, 20 Drawing Sheets

FAN FRAME OF AN AXIAL-FLOW FAN

CROSS REFERENCE TO RELATED APPLICATIONS

The application claims the benefit of Taiwan application serial No. 105217769, filed on Nov. 21, 2016, and the contents of which are incorporated herein by reference.

BACKGROUND OF THE INVENTION

1. Field of the Invention

The present disclosure generally relates to a fan frame of an axial-flow fan and, more particularly, to a fan frame of an axial-flow fan with reduced vibration.

2. Description of the Related Art

FIG. 1 shows a conventional axial-flow fan 9 including an impeller 91, a fan frame 92 and a plurality of vibration-reducing members 93. The impeller 91 is rotatably mounted in the fan frame 92. The vibration-reducing members 93 are coupled with the lateral wall of the fan frame 92. The vibration-reducing members 93 are made of a material with excellent elasticity in order to provide a buffering function. Thus, during the rotation of the impeller 91, the vibration of the impeller 91 that is transmitted to the outside through the fan frame 92 can be minimized. One embodiment of such a conventional axial-flow fan 9 can be seen in Taiwan Patent No. M445644 entitled "Fan and Fan Frame thereof."

However, the conventional axial-flow fan 9 requires the vibration-reducing members 93 to be coupled with the outer periphery of the fan frame 92. Since the fan frame 92 and the vibration-reducing members 93 are separate elements, each of the fan frame 92 and the vibration-reducing members 93 needs to have an engagement structure for assembly purpose. However, this increases the structural complexity of the axial-flow fan 9.

Furthermore, the axial-flow fan 9 requires each of the vibration-reducing members 93 to be attached to a predetermined location of the fan frame 92, and then a plurality of fixing members 94 is used to screw the vibration-reducing member 93 to the fan frame 92 to complete the assembly. Therefore, the assembly procedure is complex and the assembly efficiency is low.

Based on this, it is needed to improve the conventional axial-flow fan 9.

SUMMARY OF THE INVENTION

It is therefore the objective of this disclosure to provide a fan frame of an axial-flow fan which uses a plurality of specially designed connection members to reduce the vibration of the impeller that is transmitted to the outside of the fan through the fan frame.

The term "circular arc" mentioned hereinafter refers to a part of the circumference of a circle. The term "elliptical arc" mentioned hereinafter refers to a part of the perimeter of an ellipse. The term "spiral" mentioned hereinafter refers to a plane curve which is generated by a point moving around a fixed point while constantly receding from or approaching it, such as Archimedean spiral, an involute or an equiangular spiral, as it can be readily appreciated by the person skilled in the art.

In an embodiment, a fan frame of an axial-flow fan including a housing, a base and a plurality of connection members is disclosed. The base includes a shaft-coupling portion. Each of the plurality of connection members includes two ends respectively connected to the housing and the base. Each of the plurality of connection members is defined with an extension line passing through the two ends of the connection member. Each of the plurality of connection members includes a first bending portion and a second bending portion. The first bending portion extends around a first notch, and the second bending portion extends around a second notch. The extension line extends through the first and second notches.

The extension line is defined with two sides spaced from each other in a transverse direction, and the first and second bending portions are respectively located at the two sides of the extension line.

In a form shown, the first and second bending portions are connected to each other, so as to improve the ability of the connection member to absorb the vibration energy.

In another form shown, the first and second bending portions are spaced from each other, so as to improve the structural strength of the connection member.

The fan frame of the axial-flow fan further includes another first bending portion. The first bending portions and the second bending portion are arranged in an interlaced manner.

The shaft-coupling portion extends in an axial direction perpendicular to the transverse direction. As such, each of the first and second bending portions can protrude in a direction perpendicular to the axial direction, thus reducing the height of the connection member.

Each of the plurality of connection members further includes a third bending portion and a fourth bending portion. The third bending portion extends around a third notch, and the fourth bending portion extends around a fourth notch. The extension line extends through the third and fourth notches. The extension line also is further defined with two sides spaced from each other in a vertical direction perpendicular to the transverse direction. The third and fourth bending portions are respectively located at the two sides of the extension line in the vertical direction. As such, the first and second bending portions can effectively reduce the vibration that is transmitted in the transverse direction, and the third and fourth bending portions can effectively reduce the vibration that is transmitted in the vertical direction. Therefore, the fan frame is able to reduce the vibration that is transmitted in various directions, further improving the vibration-reducing effect.

The shaft-coupling portion extends in an axial direction parallel to the vertical direction. As such, the first and second bending portions can effectively reduce the vibration that is transmitted in a direction perpendicular to the axial direction (i.e. the transverse direction), and the third and fourth bending portions can effectively reduce the vibration that is transmitted in a direction parallel to the axial direction (i.e. the vertical direction). Therefore, the fan frame is able to reduce the vibration that is transmitted in various directions, further improving the vibration-reducing effect.

The extension line is defined with two sides spaced from each other in a vertical direction. The first and second bending portions are respectively located at the two sides of the extension line, and the shaft-coupling portion extends in an axial direction parallel to the vertical direction. As such, each of the first and second bending portions can protrude in a direction parallel to the axial direction. The first bending portion (or the second bending portion) can prevent the air current from passing through the first notch (or the second notch) in the axial direction, thus avoiding noise.

The extension line is in a linear form such that the connection member can extend to the housing in a linear form.

The extension line is in a curved form including a circular arc, an elliptical arc or a spiral. As such, each of the connection members is able to change the flowing direction of the air current flowing into or out of the housing.

The housing has two sides spaced from each other in an axial direction. The housing includes two openings respectively located at the two sides of the housing. The plurality of connection members is arranged at one of the two openings of the housing. As such, the connection members can be used as air-guiding stationary blades for adjusting the flowing direction of the incoming or outgoing air current.

The first or second bending portion is in a shape having a pair of parallel bars and a crossbar connected between the parallel bars, or is in a V-shaped form. Besides, the first bending portion may have the same shape as the second bending portion. As such, when the first and second bending portions are connected to each other, the connection member may be in a zig-zag shape, a wave shape, or a shape with continuous grids.

The first bending portion has a different size or shape from the second bending portion. As such, the connection member can have a flexible design. For example, the first bending portion or the second bending portion that is most adjacent to the base can be designed in a larger size to absorb the larger vibration energy, and the first bending portion or the second bending portion that is most distant to the base can be designed in a smaller size to reduce the dimension of the connection member.

Each of the connection members is a connecting rib or an air-guiding stationary blade. Based on this, the connection members can be used to connect the housing to the base, or to adjust the flowing directions of the air currents flowing into or out of the housing.

Based on the above structures, in the fan frame of the axial-flow fan of the disclosure, the connection member can provide a longer path when used as a medium through which the vibration generated during the rotation of the impeller is transmitted. Therefore, when the vibration generated during the rotation of the impeller transmits to the housing through the base and the connection member, the connection member can more effectively absorb the vibration energy of the impeller. Furthermore, since the first and second bending portions have a sufficient room for deformation, the connection member can effectively absorb the vibration energy. Based on the above, the connection member is able to effectively absorb the vibration energy of the impeller, attaining the vibration-reducing effect. This can reduce the vibration (which is generated during the rotation of the impeller) that is transmitted to the outside of the axial-flow fan via the fan frame. Moreover, the fan frame of the axial-flow fan of the disclosure does not require other vibration-reducing members and can have a simplified structure.

BRIEF DESCRIPTION OF THE DRAWINGS

The present disclosure will become more fully understood from the detailed description given hereinafter and the accompanying drawings which are given by way of illustration only, and thus are not limitative of the present disclosure, and wherein.

Figure 1:
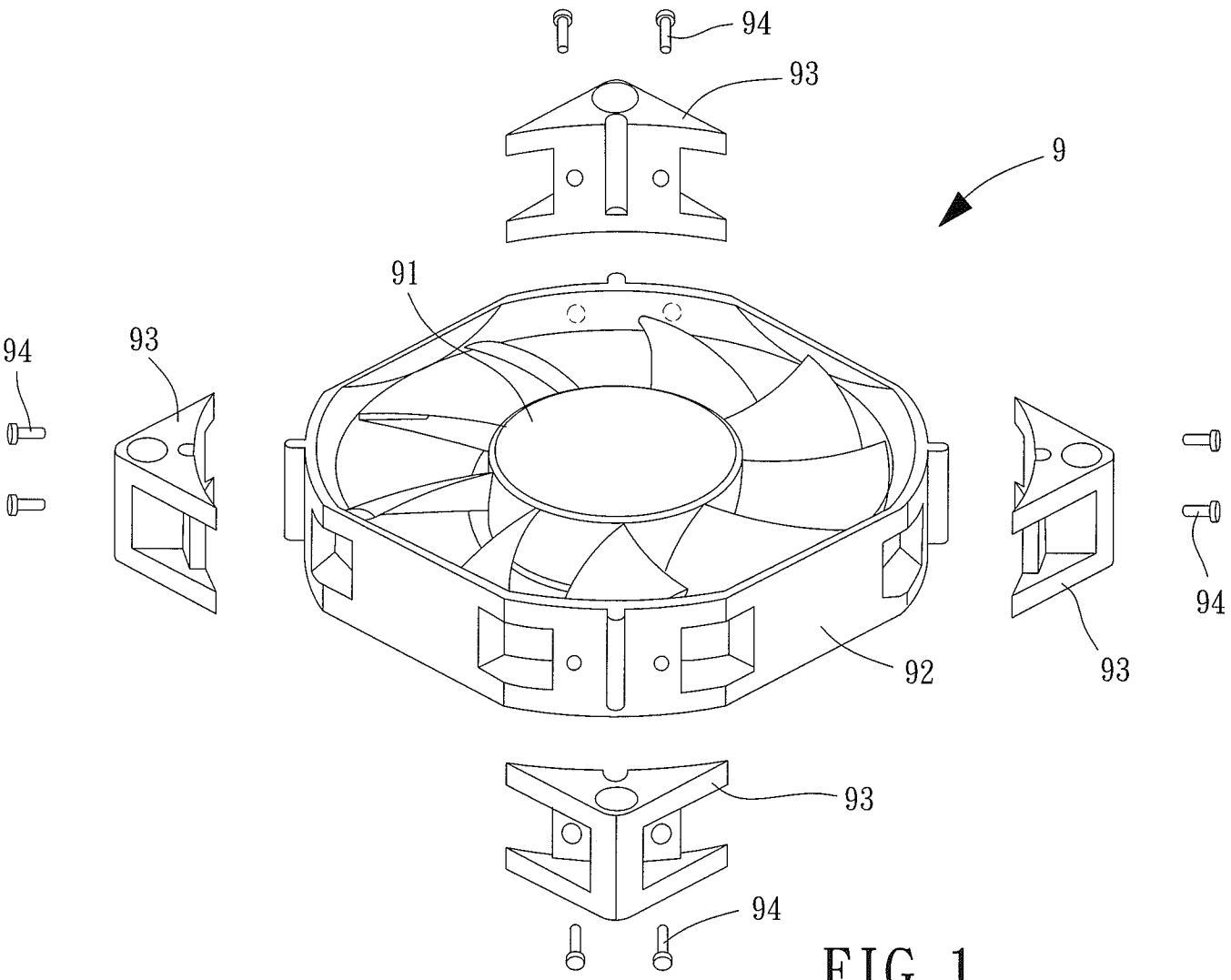
FIG. 1 PRIOR ART
FIG. 1 is an exploded view of a conventional axial-flow fan.

In the various figures of the drawings, the same numerals designate the same or similar parts. Furthermore, when the terms "first", "second", "third", "fourth", "inner", "outer", "top" and similar terms are used hereinafter, it should be understood that these terms have reference only to the structure shown in the drawings as it would appear to a person viewing the drawings, and are utilized only to facilitate describing the disclosure.

DETAILED DESCRIPTION OF THE INVENTION

Figure 2:
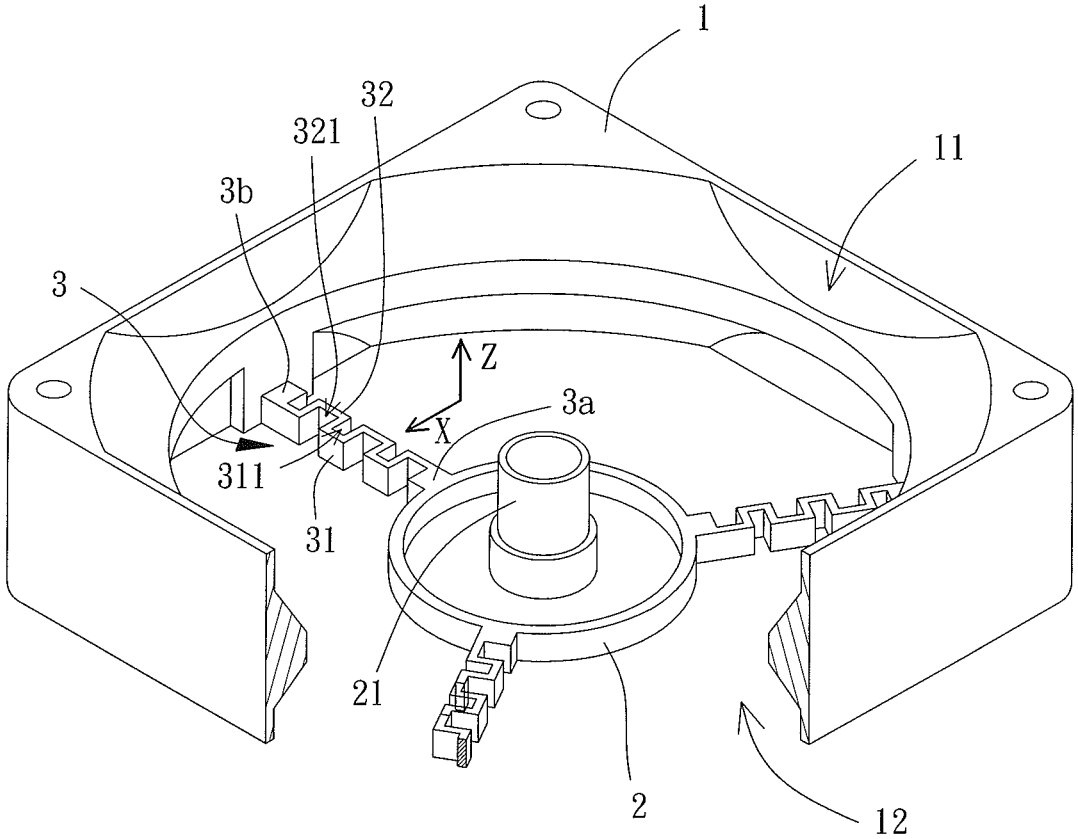
FIG. 2 shows a fan frame of an axial-flow fan according to a first embodiment of the disclosure.
Figure 3:
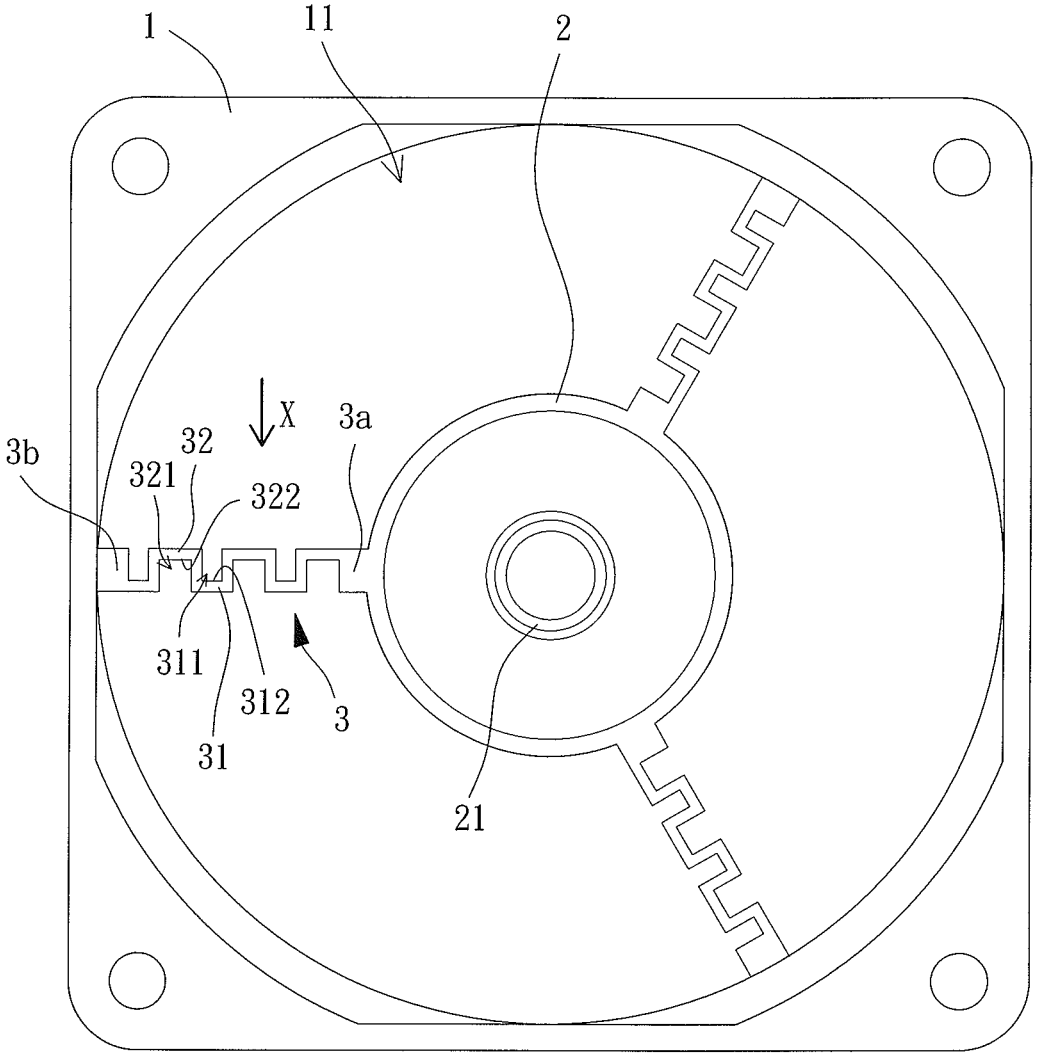
FIG. 3 is a top view of the fan frame of the axial-flow fan according to the first embodiment of the disclosure.

FIGS. 2 and 3 show a fan frame of an axial-flow fan according to a first embodiment of the disclosure. The fan frame includes a housing 1, a base 2 and a plurality of connection members 3. Each of the connection members 3 is connected between the housing 1 and the base 2. The housing 1 includes two sides spaced from each other in an axial direction Z. The housing 1 includes two openings 11 and 12 respectively located at the two sides of the housing 1, and each of the two openings 11 and 12 can serve as an air inlet or air outlet of the axial-flow fan.

The base 2 includes a shaft-coupling portion 21 extending in the axial direction Z. The shaft of the axial-flow fan can couple with the shaft-coupling portion 21. Specifically, the shaft-coupling portion 21 may receive a bearing in which the shaft can be received. This permits the shaft to be rotatably received in the shaft-coupling portion 21. The base 2 may be arranged at one of the two openings 11 and 12 of the housing 1. However, in another embodiment of the disclosure, the base 2 can also be arranged between the two openings 11 and 12. The disclosure is not limited to either embodiment.

Figure 4A:
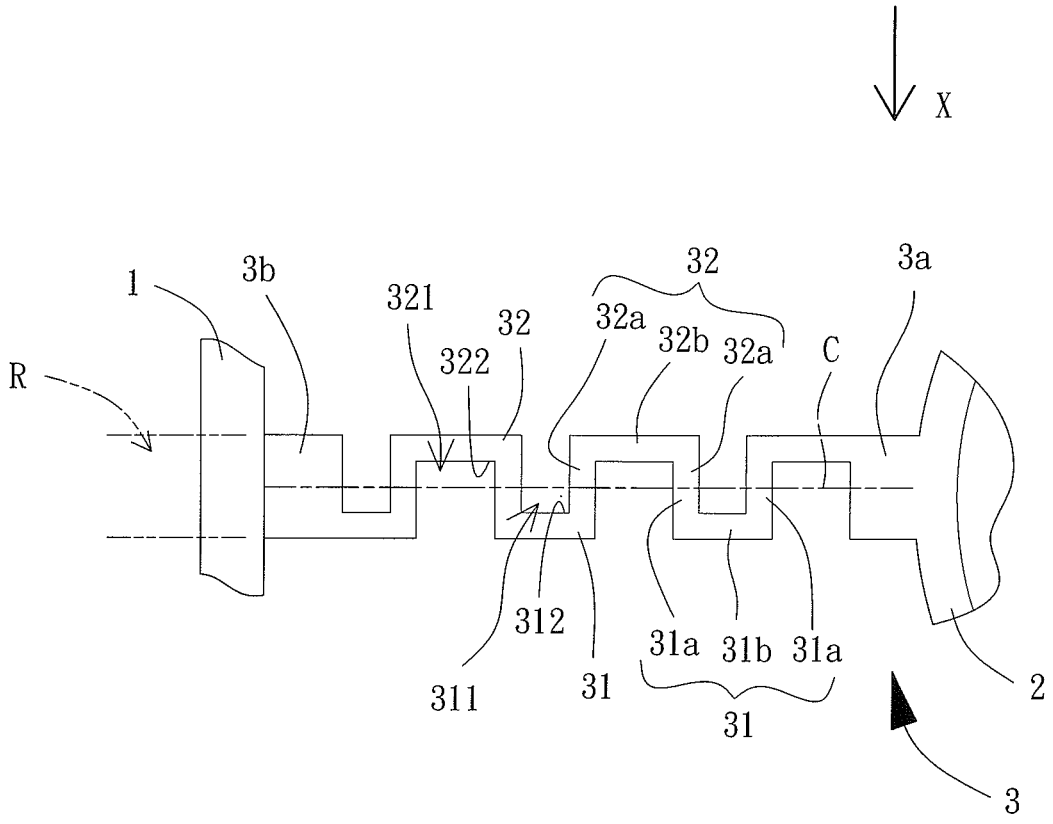
FIG. 4*a* is a top view of a connection member of the fan frame of the axial-flow fan according to the first embodiment of the disclosure.
Figure 4B:
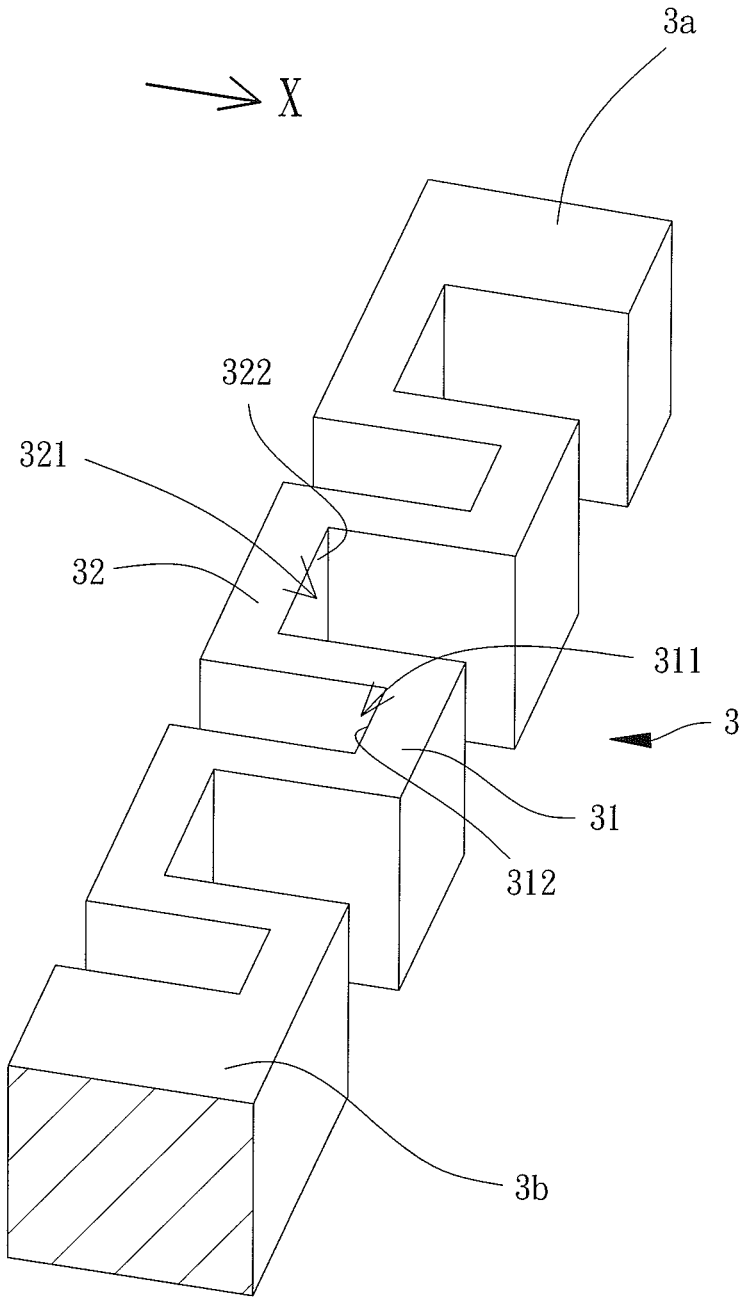
FIG. 4*b* shows the connection member of the fan frame of the axial-flow fan according to the first embodiment of the disclosure.

Referring to FIGS. 4*a* and 4*b*, two ends 3*a* and 3*b* of each connection member 3 are connected to the base 2 and the housing 1, respectively. The connection member 3 is provided with an extension line C connecting between the two ends 3*a* and 3*b* of the connection member 3. Each connection member 3 includes at least one first bending portion 31 and at least one second bending portion 32. Specifically, the extension line C is in the form of a straight line, a circular arc, an elliptical arc or a spiral. The extension line C extends from the end 3*a* to the end 3*b* of the connection member 3. The extension line C is in the form of a straight line in this embodiment. The first bending portion 31 extends around a first notch 311, and the second bending portion 32 extends around a second notch 321. The extension line C extends through the first notch 311 and the second notch 321, such that the first notch 311 and the second notch 321 are aligned with each other in the extending direction of the extension line C.

The extension line C is defined with two sides spaced from each other in a transverse direction X. The first bending portion(s) 31 is located at one of the two sides of the extension line C, and the second bending portion(s) 32 is located at another of the two sides of the extension line C. The transverse direction X may be perpendicular to the extension line C. In other words, the first bending portion 31 and the second bending portion 32 are located at the two sides of the extension line C, respectively. Specifically, the first bending portion 31 includes a first inner face 312 facing the first notch 311, and the second bending portion 32 includes a second inner face 322 facing the second notch 321. The first inner face 312 and the second inner face 322 are located at the two sides of the extension line C and face the extension line C.

More specifically, referring to FIG. 4*a*, the first bending portion 31 may include two protruding portions 31*a* and an extension portion 31*b* in this embodiment. Each protruding portion 31*a* extends in the transverse direction X and extends outward from the extension line C at one of the sides of the extension line C. The extension portion 31*b* is connected between the two protruding portions 31*a*. As such, the first bending portion 31 may appear a "U" shape having a pair of parallel bars and a crossbar connected between the parallel bars. The two protruding portions 31*a* and the extension portion 31*b* may jointly form the first notch 311. Similarly, the second bending portion 32 may include two protruding portions 32*a* and an extension portion 32*b*. The two protruding portions 32*a* extend outward from the extension line C in a direction opposite to the transverse direction X, and the extension portion 32*b* is connected between the two protruding portions 32*a*. As such, the second bending portion 32 appears a "U" shape having one crossbar and two sides running parallel to each other and perpendicular to the crossbar, in which the two protruding portions 32*a* and the extension portion 32*b* jointly form the second notch 321. When each of the first bending portion(s) 31 and the second bending portion(s) 32 is in a "U" shape and connected to each other, the connection member 3 can have a shape with continuous grids.

Based on the above structure, during the use of the fan frame of the axial-flow fan according to the first embodiment of the disclosure, a shaft may be rotatably coupled to the shaft-coupling portion 21. An impeller may be coupled with the shaft, and the vibration may be caused during the rotation of the impeller. In the first embodiment, since the connection members 3 are connected between the housing 1 and the base 2 and since the first notch 311 (formed by the first bending portion 31) and the second notch 321 (formed by the second bending portion 32) are aligned with each other in the extension line C to provide a larger room for deformation of the first bending portion(s) 31 and the second bending portion(s) 32, the connection members 3 can more efficiently reduce the vibration (or absorb the vibration energy) of the impeller. As such, the vibration-reducing effect is provided.

Furthermore, since the first bending portion(s) 31 and the second bending portion(s) 32 are respectively located at two sides of the extension line C, arrangement of the first bending portion(s) 31 and the second bending portion(s) 32 can effectively increase the length of the connection member 3. As such, the connection member 3 can provide a longer path when used as a medium through which the vibration generated during the rotation of the impeller is transmitted. Therefore, when the vibration generated during the rotation of the impeller transmits to the housing 1 through the base 2 and the connection member 3, the connection member 3 can more effectively absorb the vibration generated during the rotation of the impeller. Advantageously, the vibration of the housing 1 can be reduced.

Based on the above concepts, the features of the fan frames of the axial-flow fans as proposed in various embodiments of the disclosure are elaborated below.

Figure 5:
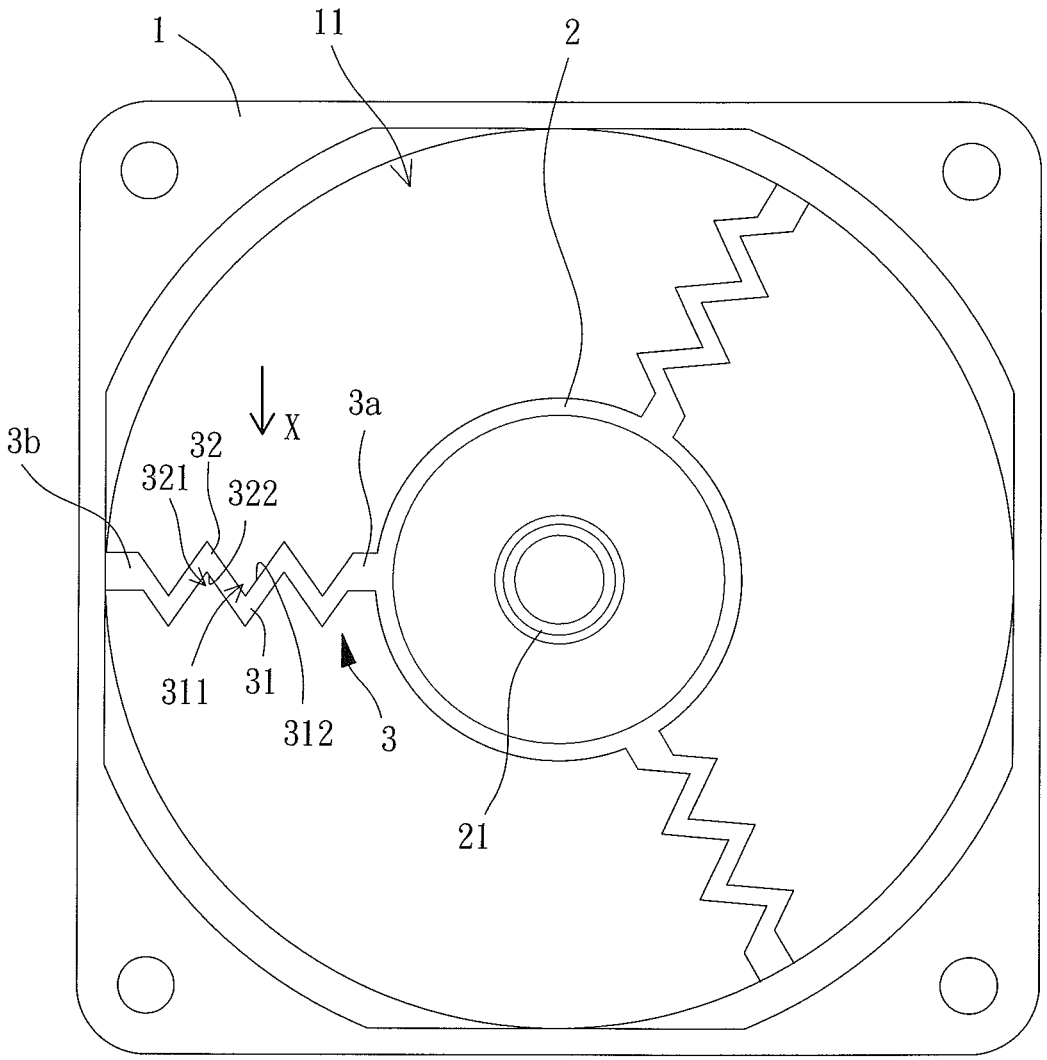
FIG. 5 is a top view of a fan frame of an axial-flow fan according to a second embodiment of the disclosure.
Figure 6A:
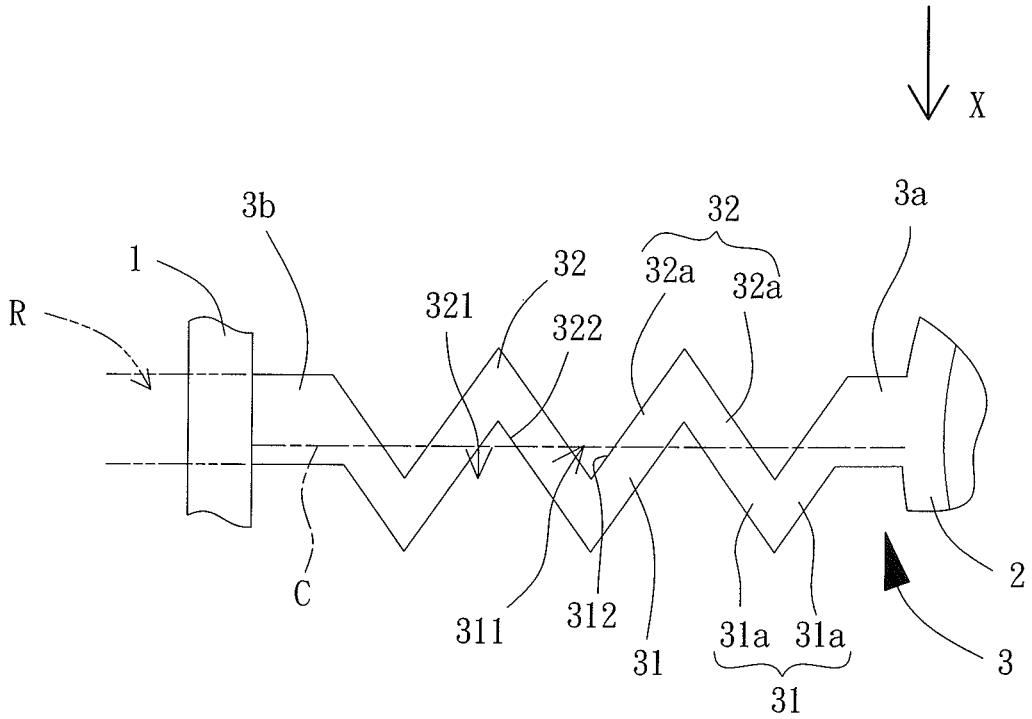
FIG. 6*a* is a top view of a connection member of the fan frame of the axial-flow fan according to the second embodiment of the disclosure.
Figure 6B:
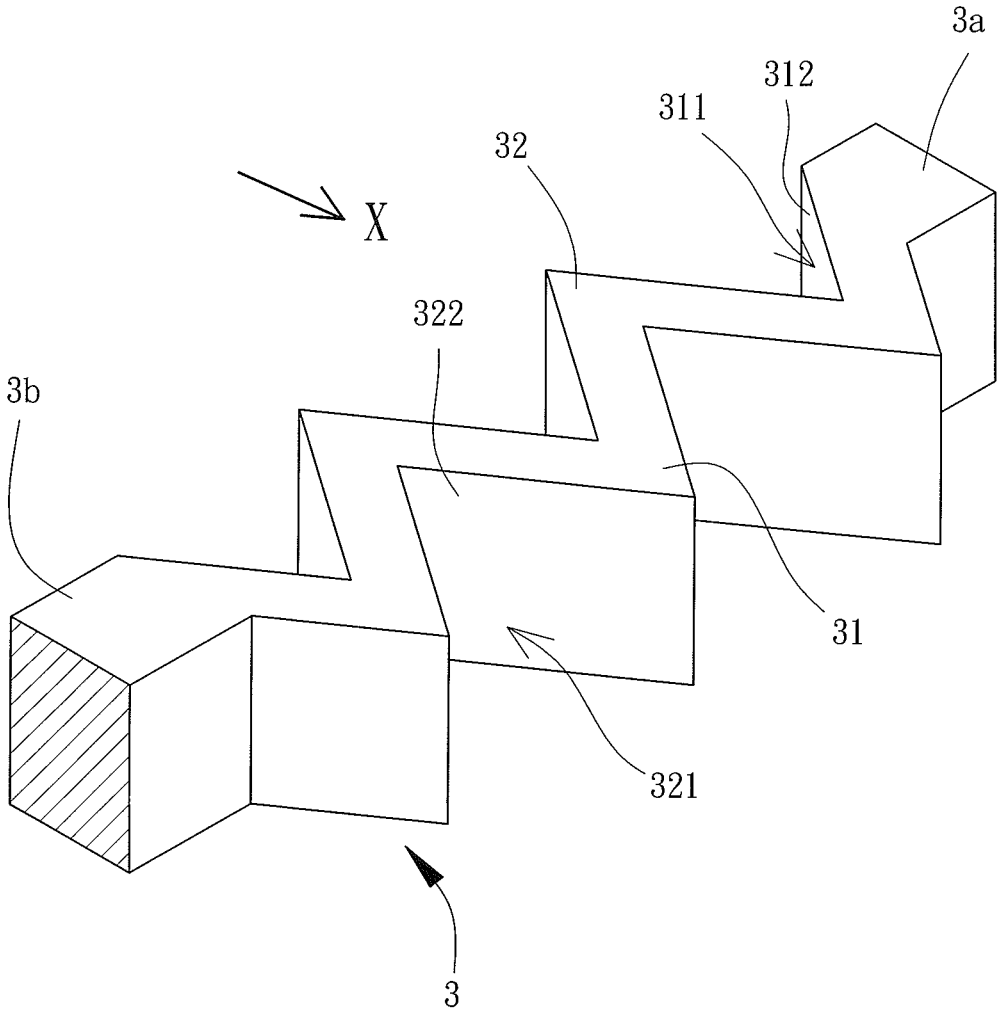
FIG. 6*b* shows the connection member of the fan frame of the axial-flow fan according to the second embodiment of the disclosure.

Specifically, although each of the first bending portion(s) 31 and the second bending portion(s) 32 is in a "U" shape in the first embodiment, each of the first bending portion 31 and the second bending portion 32 is in a "V" shape in a second embodiment of the disclosure as shown in FIGS. 5, 6*a* and 6*b*. In the second embodiment, when the V-shaped first bending portion(s) 31 and second bending portion(s) 32 are connected together, the connection member 3 is in the zig-zag form. In other words, the shape of the first bending portion(s) 31 and the second bending portion(s) 32 is not limited in the disclosure.

More specifically, as shown in FIG. 6*a*, the first bending portion 31 may include two protruding portions 31*a* in this embodiment. Both the protruding portions 31*a* protrude in the transverse direction X and are connected to each other. Thus, the two protruding portions 31*a* can jointly form a "V" shape and can connect to each other to form the first notch 311. Likewise, the second bending portion 32 may include two protruding portions 32*a* in this embodiment. Both the two protruding portions 32*a* protrude in a direction opposite to the transverse direction X and are connected to each other. Thus, the two protruding portions 32*a* can jointly form a "V" shape and can connect to each other to form the second notch 321.

Figure 7:
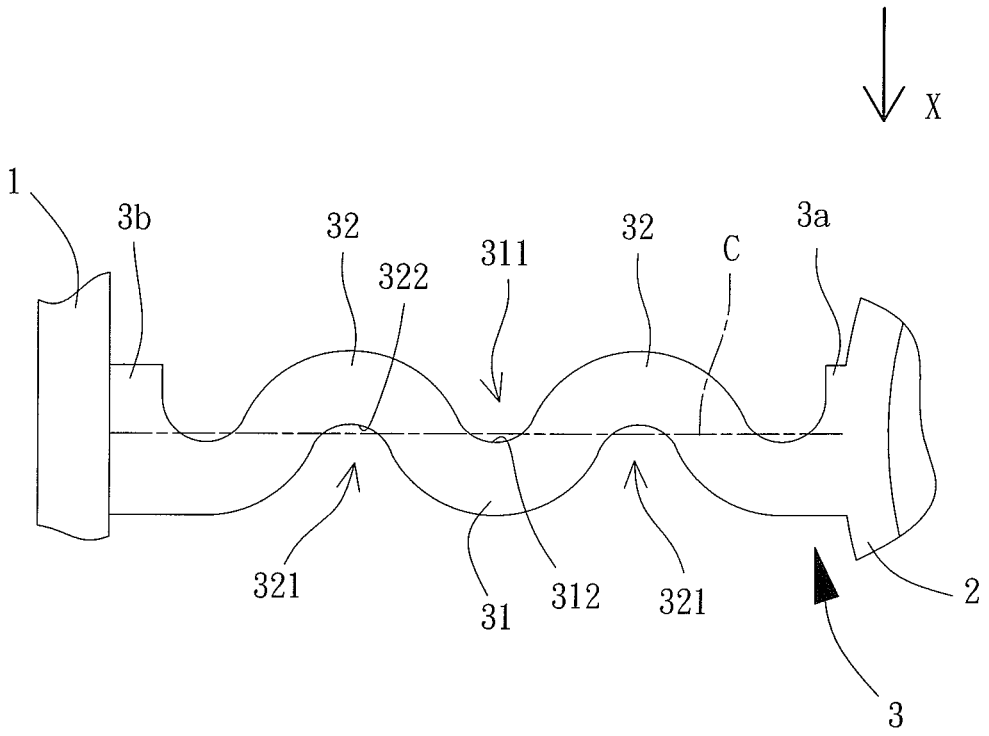
FIG. 7 is a top view of a connection member in a wave shape.

Besides, in another embodiment of the disclosure, each of the first bending portion(s) 31 and the second bending portion(s) 32 can be in an arc shape as shown in FIG. 7. In this case, the first bending portion(s) 31 and the second bending portion(s) 32 can be connected to each other to form the connection member 3 in a wave shape.

Figure 8:
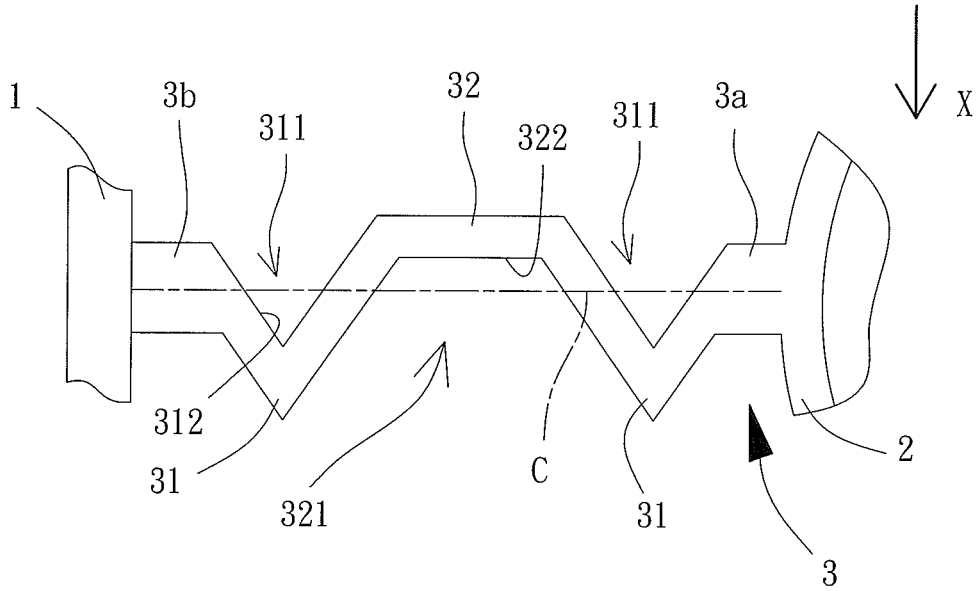
FIG. 8 is a top view of a connection member where the first bending portions have a different shape from that of the second bending portion.

Although the first bending portion(s) 31 and the second bending portion(s) 32 can be in the same shape in the previous embodiments, they may be in different shapes. For example, as shown in FIG. 8, the first bending portion 31 may be in a "V" shape, and the second bending portion 32 may be in a "U" shape different from the first bending portion 31.

Figure 9:
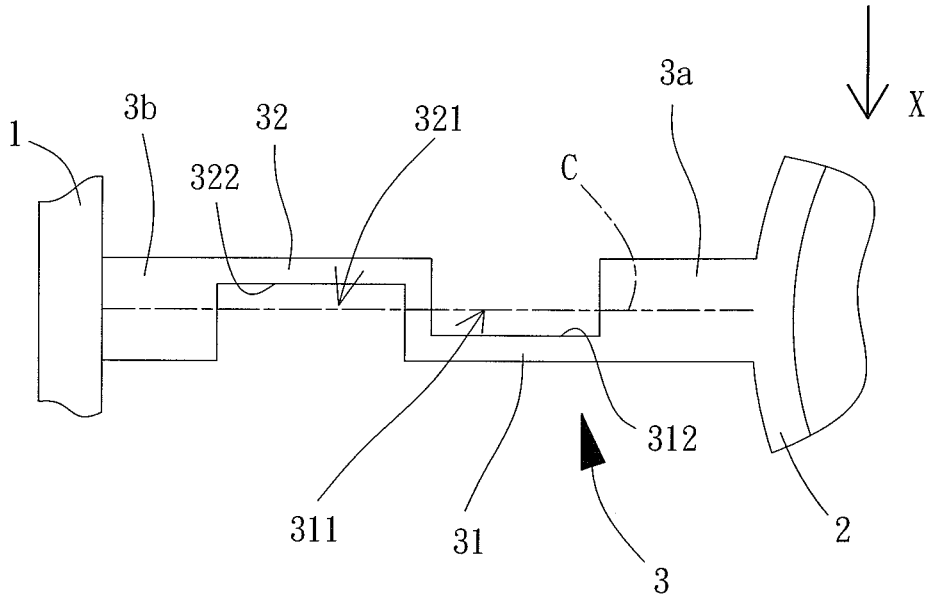
FIG. 9 is a top view of a connection member having only one first bending portion and only one second bending portion.
Figure 10:
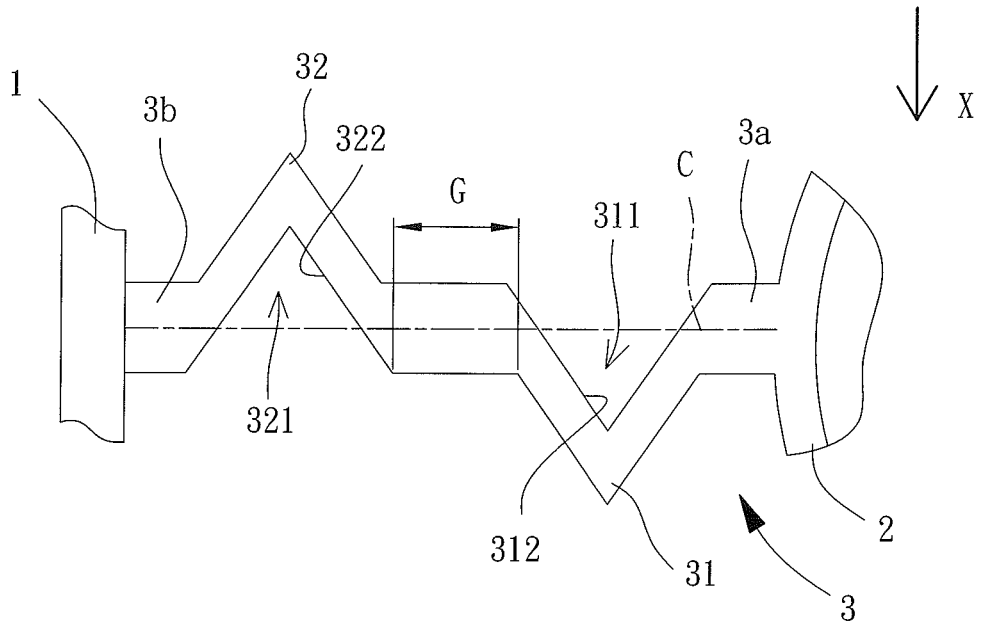
FIG. 10 is a top view of a connection member where the first and second bending portions are spaced from each other.

Referring to FIGS. 3, 5, 7 and 8, the at least one first bending portion 31 may include a plurality of first bending portions 31, or the at least one second bending portion 32 may include a plurality of second bending portions 32. In this regard, the at least one first bending portion 31 and the at least one second bending portion 32 can be arranged in an interlaced manner to increase the length of the connection member 3. There may be only one first bending portion 31 and only one second bending portion 32 as shown in FIG. 9. Besides, the first bending portion 31 and the second bending portion 32 can directly connect to each other to enhance the ability of the connection member 3 to absorb the vibration energy. However, in the extension direction of the extension line C, the first bending portion 31 and the second bending portion 32 may be spaced from each other at a gap G as shown in FIG. 10. In this structure, the first bending portion 31 and the second bending portion 32 are spaced from each other to enhance the structural strength of the connection member 3.

Figure 11:
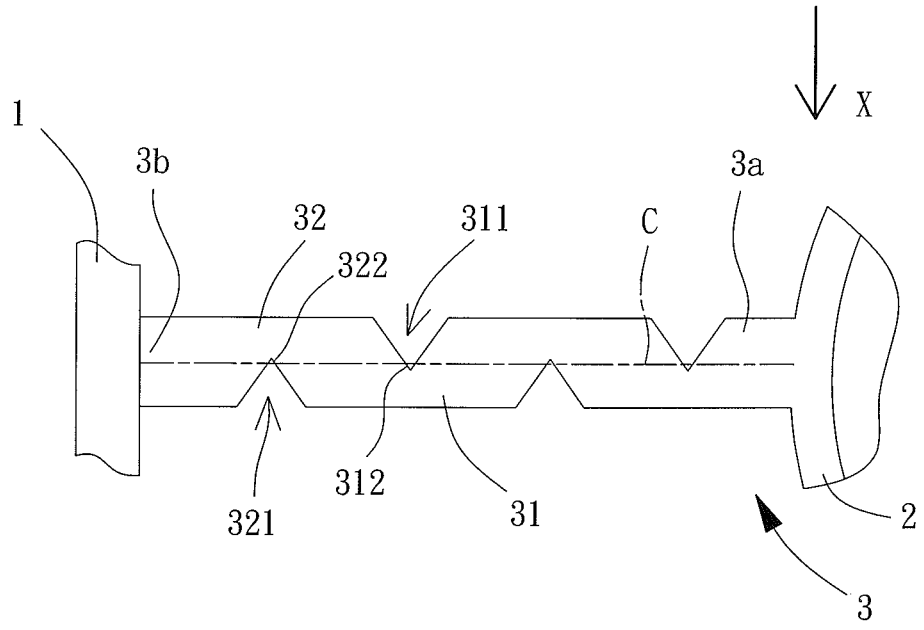
FIG. 11 is a top view of a connection member where the first and second bending portions are located within a long, narrow range extending between two ends of the connection member in a transverse direction.

The two ends 3*a* and 3*b* of the connection member 3 are located within a long, narrow range R in the transverse direction X. As shown in FIGS. 6*a*, 7 and 8, the first bending portion(s) 31 can protrude beyond the long, narrow range R in the transverse direction X, or the second bending portion (s) 32 can protrude beyond the long, narrow range R in the direction opposite to the transverse direction X. As such, the connection member 3 can have an increased length. However, the first bending portion(s) 31 or the second bending portion(s) 32 can also be located within the long, narrow range R as shown in FIGS. 4*a*, 9 and 11 to reduce the dimension of the connection member 3.

Figure 12:
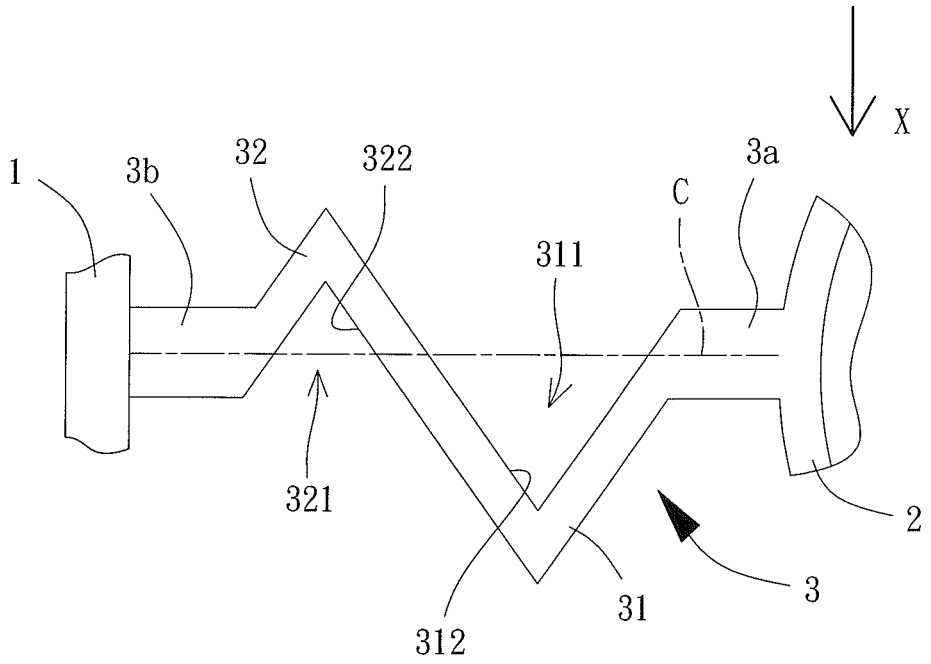
FIG. 12 is a top view of a connection member where the first bending portion has a larger size than the second bending portion.

As stated above, the first bending portion 31 may have the same shape as the second bending portion 32. Specifically, the first bending portion 31 may have the same size and shape as the second bending portion 32, or have the same shape as but different size from the second bending portion 32. For example, referring to FIG. 12, both the first bending portion 31 and the second bending portion 32 are in a "V" shape, but the first bending portion 31 has a larger size than the second bending portion 32 does. In this regard, since the vibration generated during the rotation of the impeller is always transmitted to the base 2 during the rotation thereof, the first bending portion 31 or the second bending portion 32 that is most adjacent to the base 2 can be designed in a larger size to efficiently absorb the vibration energy. Likewise, the first bending portion 31 or the second bending portion 32 that is most distant to the base 2 experiences a smaller vibration and therefore can be designed in a smaller size. As such, the dimension of the connection member 3 can be efficiently reduced.

Figure 13:
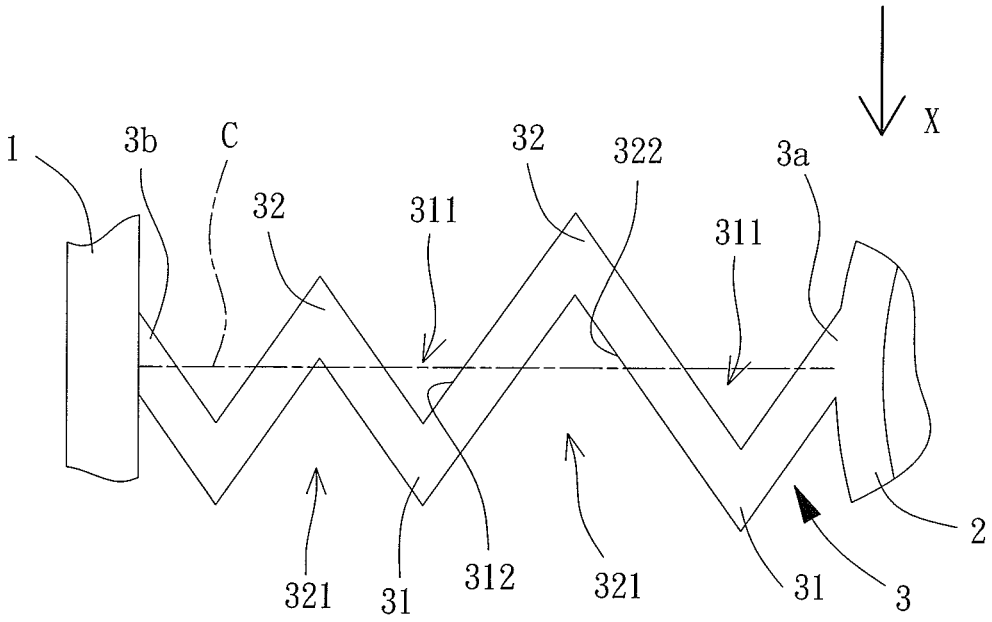
FIG. 13 is a top view of a connection member where the first bending portions have different sizes and the second bending portions have different sizes.

As stated above, the at least one first bending portion 31 may include a plurality of first bending portions 31, or the at least one second bending portion 32 may include a plurality of second bending portions 32. As an example of a plurality of first bending portions 31, each of the first bending portions 31 may have a different shape, or may have the same shape and size. Alternatively, the first bending portions 31 may also have the same shape but different sizes as shown in FIG. 13, in which the one that is most adjacent to the base preferably has a larger size in order to efficiently absorb the vibration energy. Similarly, the bending portion 31 that is most distant to the base 2 preferably has a smaller size in order to reduce the size of the connection member 3. The second bending portion 32 may also have different shapes, the same shape and size, or the same shape but different sizes.

Figure 14:
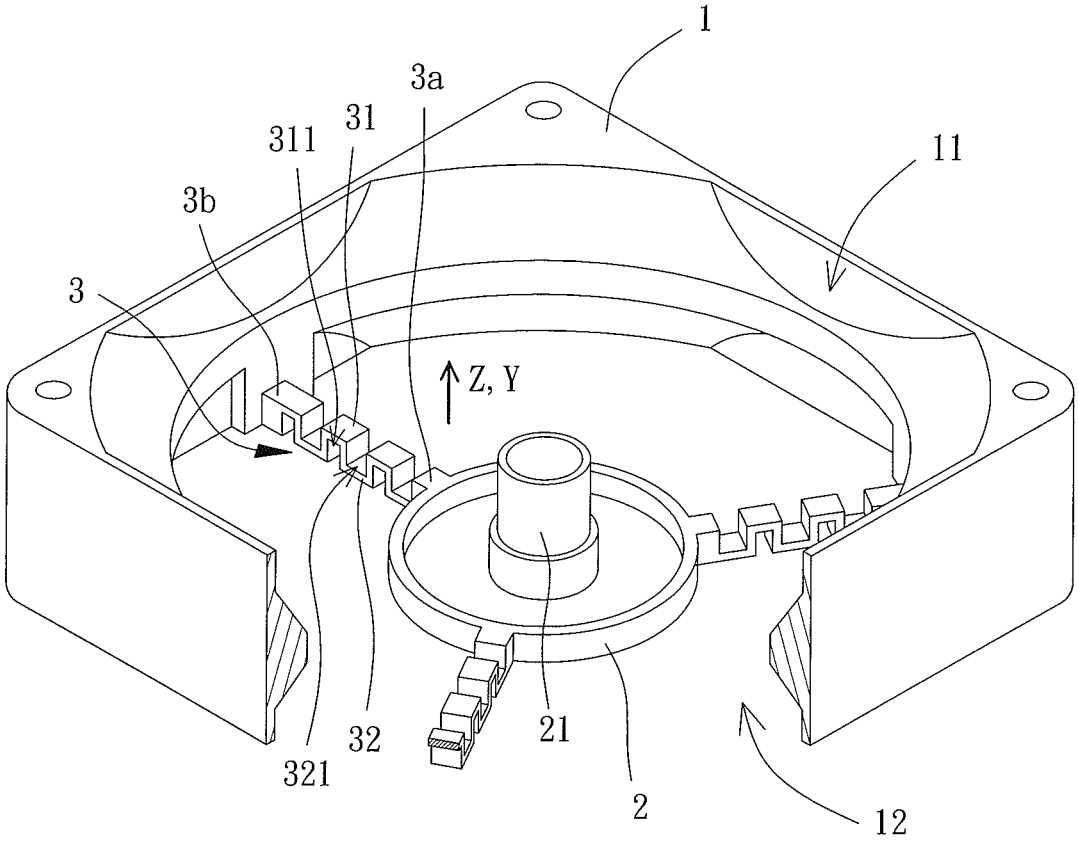
FIG. 14 shows a fan frame of an axial-flow fan according to a third embodiment of the disclosure

The first bending portion(s) 31 protrudes in the transverse direction X, and the second bending portion(s) 32 protrudes in the direction opposite to the transverse direction X. The transverse direction X is perpendicular to the axial direction Z in the first embodiment above. Each of the first bending portion(s) 31 and the second bending portion(s) 32 protrudes in a direction perpendicular to the axial direction Z, so as to reduce the height of the connection member 3. However, in another embodiment of the disclosure, the transverse direction X may also be non-parallel to the axial direction Z. FIG. 14 shows a fan frame of an axial-flow fan according to a third embodiment of the disclosure. The third embodiment differs from the first embodiment in that the first bending portion(s) 31 protrudes in a vertical direction Y, and the second bending portion(s) 32 protrudes in a direction opposite to the vertical direction Y. The vertical direction Y may be perpendicular to the extension line C and is parallel to the axial direction Z. As such, the first bending portion(s) 31 and the second bending portion(s) 32 can protrude in directions parallel to the axial direction Z. In this arrangement, the at least one first bending portion 31 (or the at least one second bending portion 32) can prevent the air currents from passing through the at least one first notch 311 (or the at least one second notch 321) in the axial direction Z, thus avoiding noise.

Figure 15:
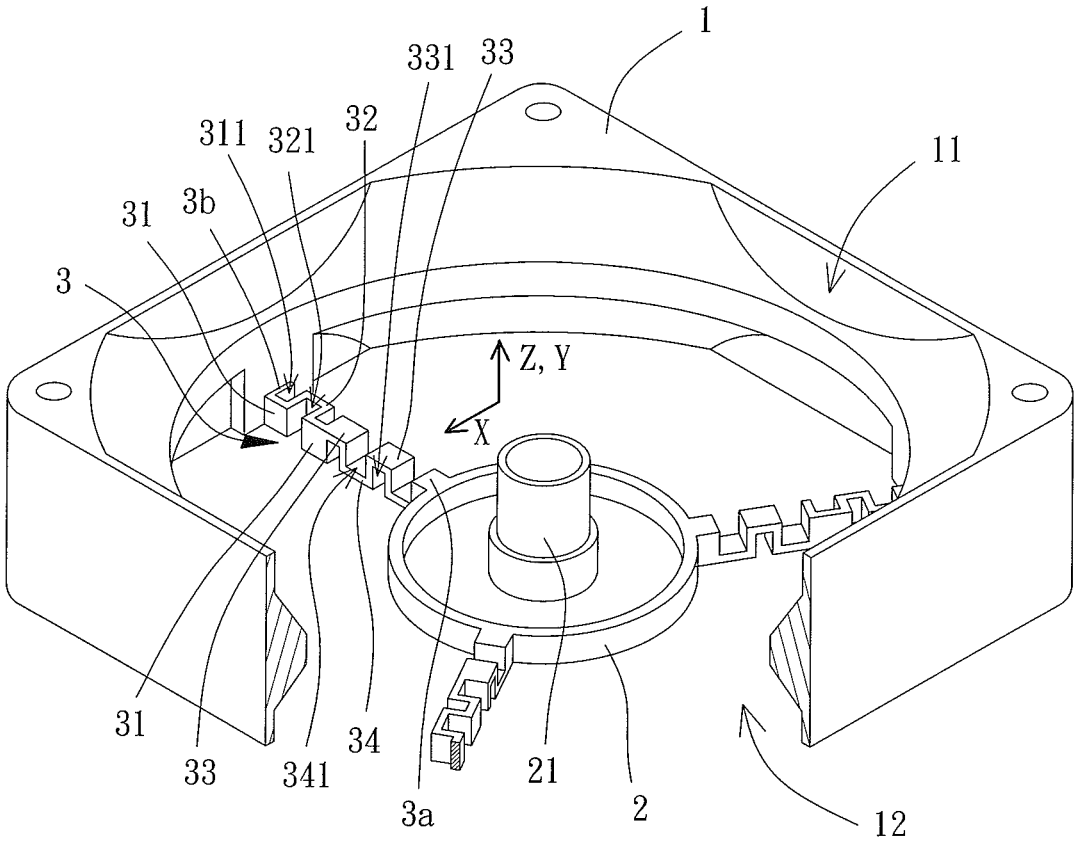
FIG. 15 shows a fan frame of an axial-flow fan according to a fourth embodiment of the disclosure.
Figure 16A:
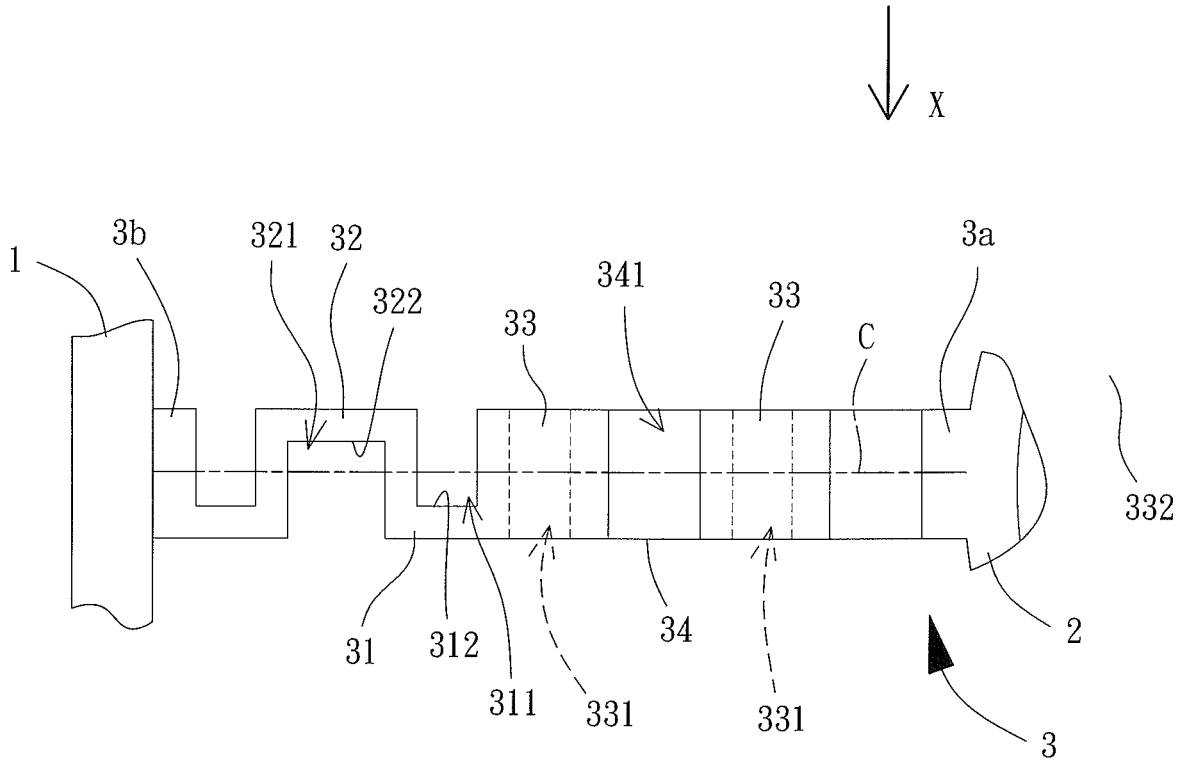
FIG. 16*a* is a top view of a connection member of the fan frame of the axial-flow fan according to the fourth embodiment of the disclosure.
Figure 16B:
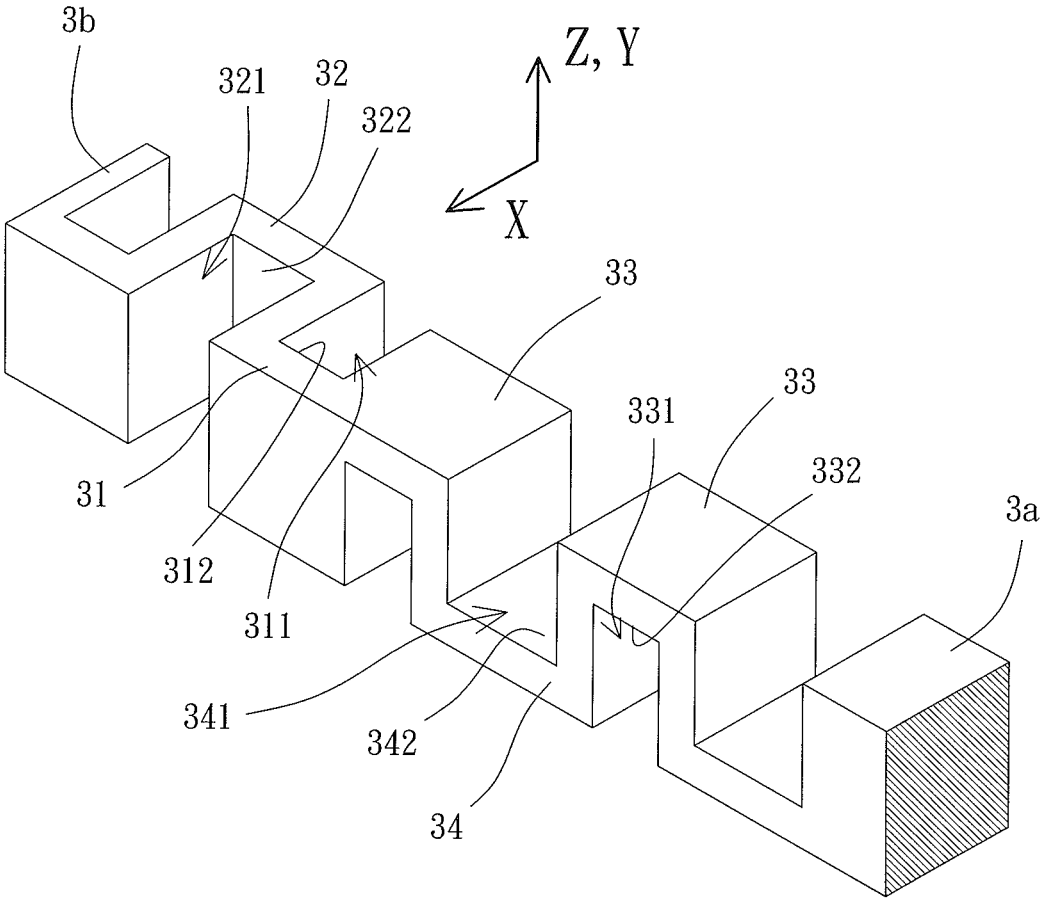
FIG. 16*b* shows the connection member of the fan frame of the axial-flow fan according to the fourth embodiment of the disclosure.

FIGS. 15, 16*a* and 16*b* show a fan frame of an axial-flow fan according to a fourth embodiment of the disclosure. The fourth embodiment differs from the first embodiment in that each of the connection members 3 further includes at least one third bending portion 33 and at least one fourth bending portion 34. The at least one third bending portion 33 is similar to the at least one second bending portion 32. The third bending portion 33 extends around a third notch 331, and the fourth bending portion 34 extends around a fourth notch 341. The extension line C extends through the third notch 331 and the fourth notch 341, such that the third notch 331 and the fourth notch 341 are aligned with each other in the extending direction of the extension line C.

The extension line C is defined with two sides spaced from each other in the vertical direction Y. The third bending portion(s) 33 is located at one of the two sides of the extension line C, and the fourth bending portion(s) 34 is located at another of the two sides of the extension line C. In other words, the third bending portion 33 and the fourth bending portion 34 are located at the two sides of the extension line C, respectively. The vertical direction Y is perpendicular to the transverse direction X. Specifically, the third bending portion 33 includes a third inner face 332 facing the third notch 331, and the fourth bending portion 34 includes a fourth inner face 342 facing the fourth notch 341.

The third inner face 332 and the fourth inner face 342 are located at the two sides of the extension line C and face the extension line C.

Based on this, the connection member 3 of the fan frame of the axial-flow fan according to the fourth embodiment of the disclosure includes the first bending portion(s) 31, the second bending portion(s) 32, the third bending portion(s) 33 and the fourth bending portion(s) 34 respectively protruding in different directions. The first bending portion(s) 31 and the second bending portion(s) 32 can effectively absorb the vibration energy transmitted in the transverse direction X, and the third bending portion(s) 33 and the fourth bending portion(s) 34 can effectively absorb the vibration energy transmitted in the vertical direction Y. Therefore, the fan frame of the axial-flow fan according to the fourth embodiment is able to absorb the vibration energy transmitted in these directions, enhancing the vibration-reducing effect.

The vertical direction Y may be parallel to the axial direction Z. Specifically, as shown in FIG. 15, the vertical direction Y is parallel to the axial direction Z so that the transverse direction X is perpendicular to the axial direction Z. However, in some embodiment of the disclosure, both the transverse direction X and the vertical direction Y are neither parallel nor perpendicular to the axial direction Z.

Figure 17:
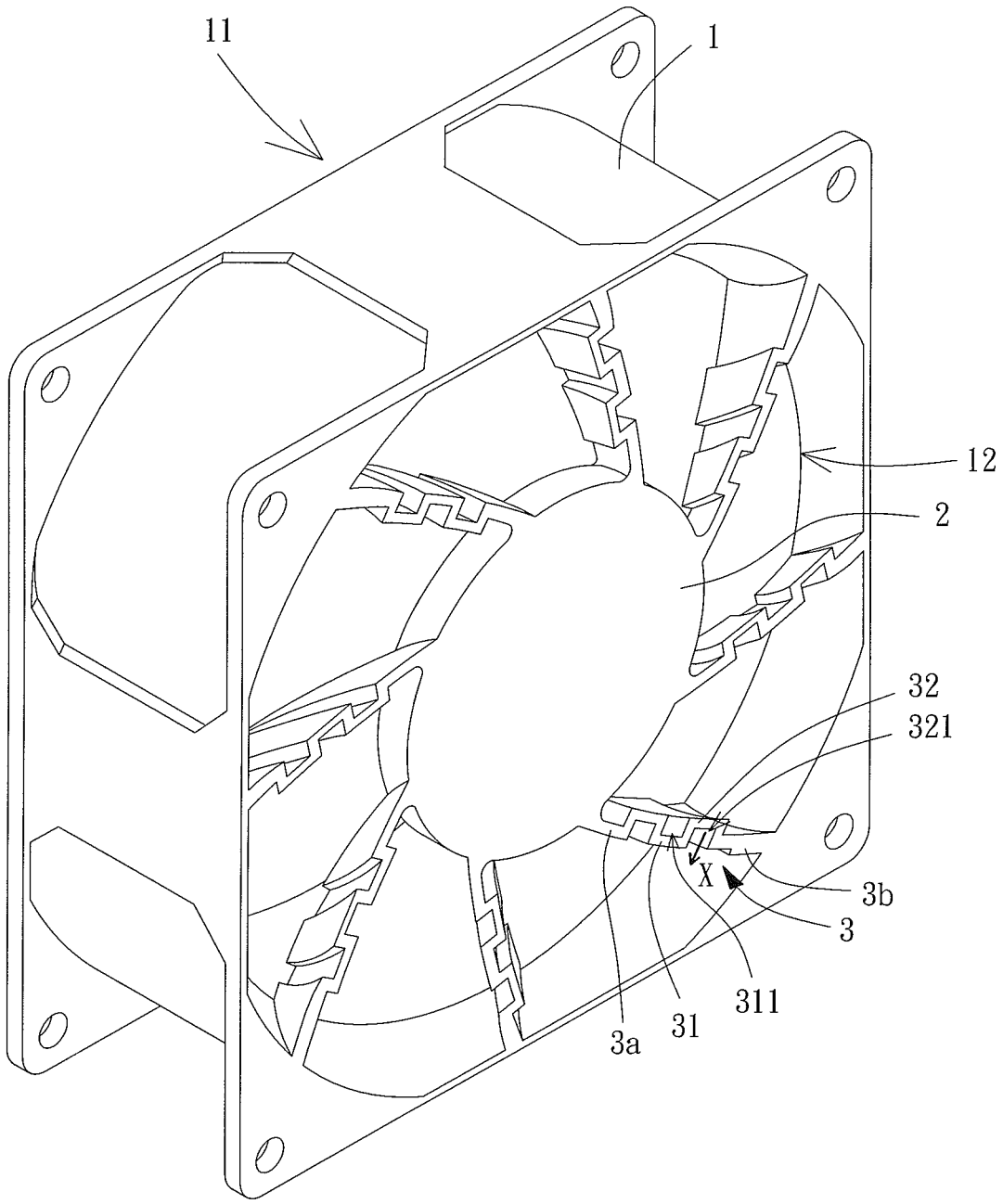
FIG. 17 shows a fan frame of an axial-flow fan according to a fifth embodiment of the disclosure.
Figure 18:
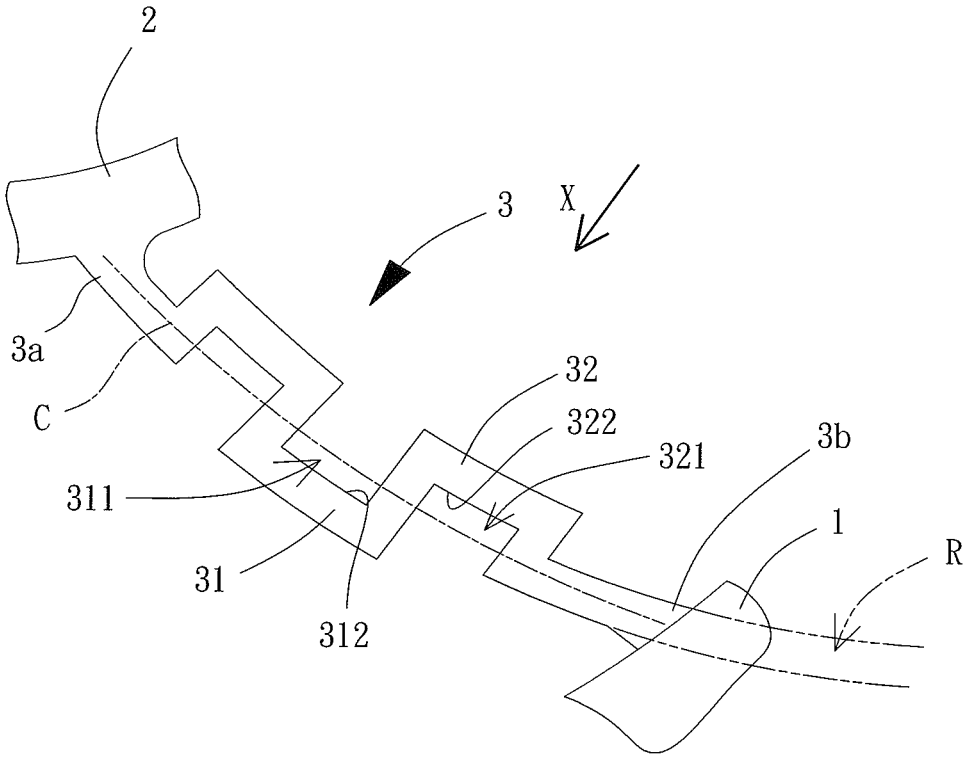
FIG. 18 is a top view of a connection member of the fan frame of the axial-flow fan according to the fifth embodiment of the disclosure.

In the previous embodiments, since the connection members 3 are connected between the housing 1 and the base 2, the connection members 3 can be regarded as connecting ribs connected between the housing 1 and the base 2. The connection member 3 extends from the end 3*a* to the end 3*b* in the extending direction of the extension line C. The extension line C may be in a linear form such that the connection member 3 can extend from the base 2 to the housing 1 in a linear manner. In this regard, FIGS. 17 and 18 show a fan frame of an axial-flow fan according to a fifth embodiment of the disclosure. The fifth embodiment differs from the previous embodiments in that the extension line C can extend in a curved manner, and that the connection members 3 can be arranged at one of the two openings 11 and 12 of the housing 1. As such, the connection members 3 are able to change the flowing direction of the air current flowing into or out of the housing 1. The connection members 3 not only can connect between the housing 1 and the base 2, but also can serve as air-guiding stationary blades for adjusting the flowing direction of the incoming or outgoing air current. It is noted that in general, if the connection member 3 serves as an air-guiding stationary blade, the connection member 3 can have a crescent shape or a half-crescent shape. Therefore, the extension line C can be in the form of a circular arc, an elliptical arc or a spiral.

In the fifth embodiment, a transverse direction X is shown to be perpendicular to the extension line C. The transverse direction X may be the extending direction of a normal line to the extension line C, and the extension line C is defined with two sides spaced from each other in the transverse direction X. As the extension line C extends in a curved manner, the first bending portion(s) 31 of the connection member 3 is located at one of the two sides of the extension line C, and the second bending portion(s) 32 of the connection member 3 is located at another of the two sides of the extension line C. The transverse direction X may still be perpendicular to the extension line C. This also effectively increases the length of the connection member 3 and provides a sufficient room for deformation of the first bending portion(s) 31 and the second bending portion(s) 32.

Figure 19:
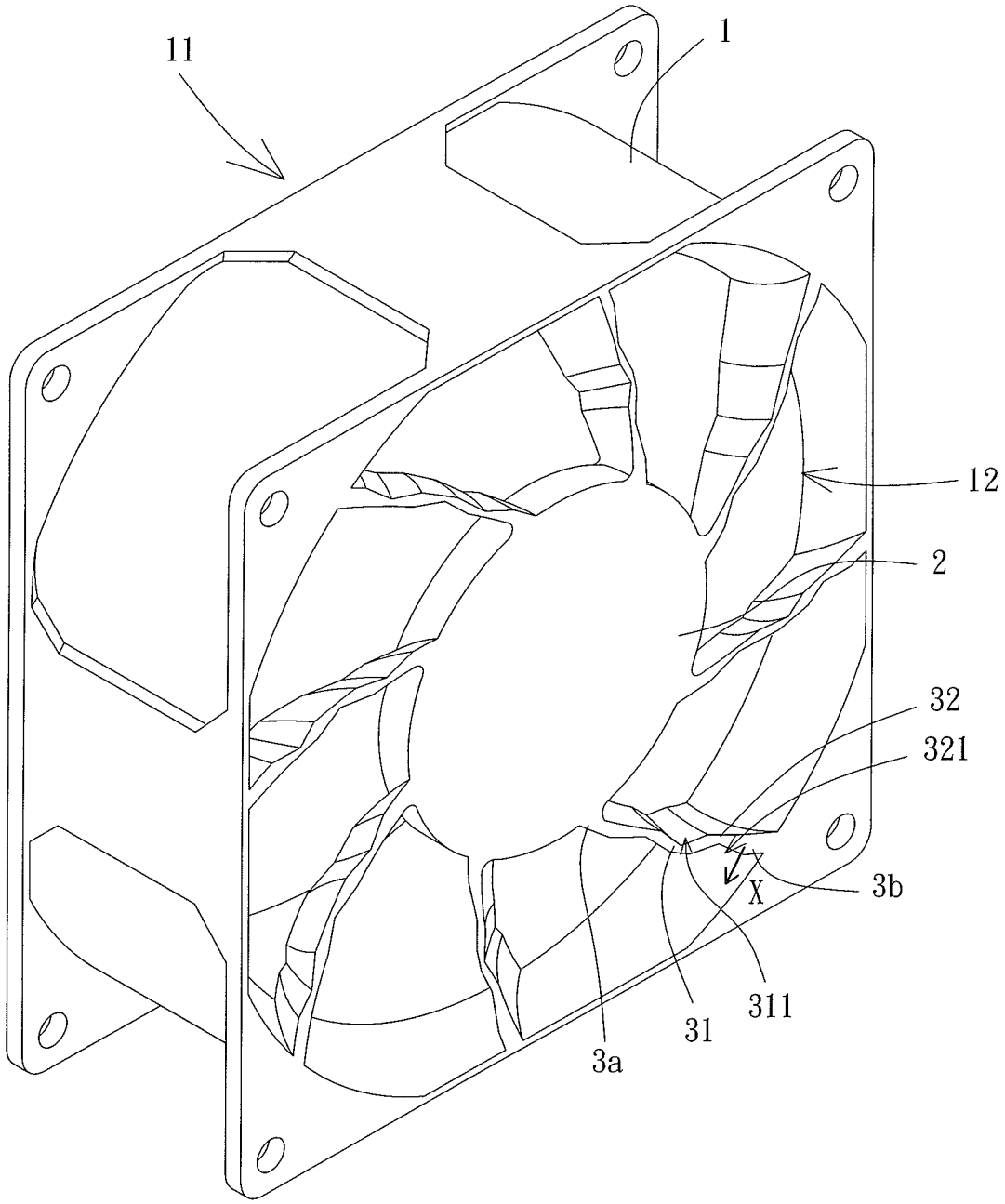
FIG. 19 shows a fan frame of an axial-flow fan according to a sixth embodiment of the disclosure.
Figure 20:
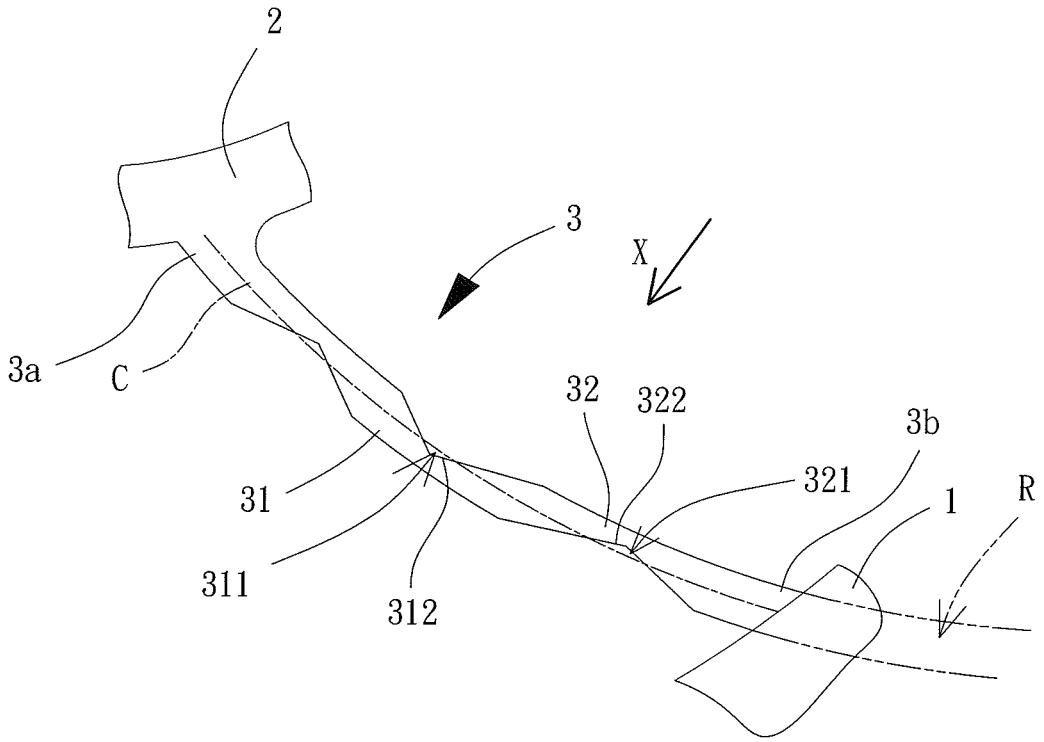
FIG. 20 is a top view of a connection member of the fan frame of the axial-flow fan according to the sixth embodiment of the disclosure.

The two ends 3*a* and 3*b* of the connection member 3 are located within a long, narrow range R in the transverse direction X. In the fifth embodiment shown in FIG. 18, the first bending portion(s) 31 can extend beyond the long, narrow range R in the transverse direction X, or the second bending portion(s) 32 can extend beyond the long, narrow range R in a direction opposite to the transverse direction X. This can further increase the length of the connection member 3. FIGS. 19 and 20 show a fan frame of an axial-flow fan according to a sixth embodiment of the disclosure. The sixth embodiment differs from the fifth embodiment in that the first bending portion(s) 31 or the second bending portion(s) 32 can be located within the long, narrow range R in the transverse direction X, permitting the connection member 3 to accurately adjust the directions of the air currents flowing into and out of the fan frame of the axial-flow fan.

Based on the above, the fan frames of the axial-flow fans as proposed by various embodiments of the disclosure include the connection members 3 connected between the housing 1 and the base 2. Each of the connection members 3 includes at least one first bending portion 31 and at least one second bending portion 32. The at least one first bending portion 31 forms at least one first notch 311, and the at least one second bending portion 32 forms at least one second notch 321. The first notch(s) 311 and the second notch(s) 321 are aligned with each other in the extending direction of the extension line C. Thus, the first bending portion(s) 31 and the second bending portion(s) 32 can have a larger room for deformation, thereby effectively absorbing the vibration energy generated during the rotation of the impeller. In addition, since the first bending portion(s) 31 and the second bending portion(s) 32 are respectively located at two sides of the extension line C, arrangement of the first bending portion(s) 31 and the second bending portion(s) 32 can effectively increase the length of the connection member 3. As such, the connection members 3 can provide a longer path when used as a medium through which the vibration generated during the rotation of the impeller is transmitted. Therefore, it can more effectively absorb the vibration energy of the impeller that is transmitted to the housing 1 through the base 2 and the connection members 3. Advantageously, the vibration of the housing 1 can be reduced. Based on this, the fan frames of the axial-flow fans as proposed in various embodiments of the disclosure can use the connection members 3 to reduce the vibration (which is generated during the rotation of the impeller) that is transmitted to the outside of the axial-flow fans via the fan frames.

As compared with the conventional axial-flow fan 9 which is complex due to the arrangement of the vibration-reducing members 93 and due to the complex assembly procedure between the fan frame 92 and the vibration-reducing members 93, the fan frames of the axial-flow fans as proposed in various embodiments of the disclosure use the connection members 3 to reduce the vibration, so that the fan frames of the axial-flow fans do not require additional vibration-reducing members and can have a simplified structure. As the conventional axial-flow fan 9 has a high structural complexity, inconvenient assembly and low assembly efficiency, the axial-flow fans of the disclosure improve upon the conventional axial-flow fan 9 in terms of structural complexity, assembly convenience and efficiency.

Although the disclosure has been described in detail with reference to its presently preferable embodiments, it will be understood by one of ordinary skill in the art that various modifications can be made without departing from the spirit and the scope of the disclosure, as set forth in the appended claims.

What is claimed is:

1. A fan frame of an axial-flow fan, comprising:

a housing;

a base having a shaft-coupling portion; and a plurality of connection members, wherein each of the plurality of connection members comprises two ends respectively connected to the housing and the base, wherein each of the plurality of connection members is defined with an extension line passing through the two ends of the connection member, wherein each of the plurality of connection members comprises a first bending portion and a second bending portion;

wherein the first bending portion extends around a first notch, and the second bending portion extends around a second notch, wherein the extension line extends through the first and second notches, and wherein the first bending portion or the second bending portion is in a shape having a pair of parallel, aligned bars and a crossbar connected between the parallel, aligned bars.

2. The fan frame of the axial-flow fan as claimed in claim 1, wherein the extension line is defined with two sides spaced from each other in a transverse direction, and wherein the first and second bending portions are located at the two sides of the extension line, respectively.

3. The fan frame of the axial-flow fan as claimed in claim 1, wherein the first and second bending portions are connected to each other.

4. The fan frame of the axial-flow fan as claimed in claim 1, wherein the first and second bending portions are spaced from each other.

5. The fan frame of the axial-flow fan as claimed in claim 1, further comprising another first bending portion, wherein the first bending portions and the second bending portion are arranged in an interlaced manner.

6. The fan frame of the axial-flow fan as claimed in claim 2, wherein the shaft-coupling portion extends in an axial direction perpendicular to the transverse direction.

7. The fan frame of the axial-flow fan as claimed in claim 2, wherein each of the plurality of connection members further comprises a third bending portion and a fourth bending portion, wherein the third bending portion extends around a third notch, wherein the fourth bending portion extends around a fourth notch, wherein the extension line extends through the third and fourth notches, wherein the extension line is further defined with two sides spaced from each other in a vertical direction perpendicular to the transverse direction, and wherein the third and fourth bending portions are respectively located at the two sides of the extension line in the vertical direction.

8. The fan frame of the axial-flow fan as claimed in claim 7, wherein the shaft-coupling portion extends in an axial direction parallel to the vertical direction.

9. The fan frame of the axial-flow fan as claimed in claim 1, wherein the extension line is defined with two sides spaced from each other in a vertical direction, wherein the first and second bending portions are respectively located at the two sides of the extension line, and wherein the shaft-coupling portion extends in an axial direction parallel to the vertical direction.

10. The fan frame of the axial-flow fan as claimed in claim 1, wherein the extension line is in a linear form.

11. The fan frame of the axial-flow fan as claimed in claim 1, wherein the extension line is in a curved form.

12. The fan frame of the axial-flow fan as claimed in claim 11, wherein the extension line is in a form of a circular arc, an elliptical arc or a spiral.

13. The fan frame of the axial-flow fan as claimed in claim 1, wherein the housing has two sides spaced from each other in an axial direction, wherein the housing comprises two openings respectively located at the two sides of the housing, and wherein the plurality of connection members is arranged at one of the two openings of the housing.

14. The fan frame of the axial-flow fan as claimed in claim 1, wherein the first or second bending portion is in a V-shaped form.

15. The fan frame of the axial-flow fan as claimed in claim 1, wherein the first or second bending portion is in a form of an arc.

16. The fan frame of the axial-flow fan as claimed in claim 1, wherein the first bending portion has a same shape as the second bending portion.

17. The fan frame of the axial-flow fan as claimed in claim 1, wherein the first bending portion has a different size from the second bending portion.

18. The fan frame of the axial-flow fan as claimed in claim 1, wherein the first bending portion has a different shape from the second bending portion.

19. The fan frame of the axial-flow fan as claimed in claim 1, wherein each of the plurality of connection members is a connecting rib or an air-guiding stationary blade.

20. The fan frame of the axial-flow fan as claimed in claim 5, further comprising another second bending portion, wherein the first bending portions and the second bending portions are arranged in the interlaced manner.

* * * * *